US005772264A

United States Patent [19]

Bettenhausen

[11] Patent Number: 5,772,264

[45] Date of Patent: Jun. 30, 1998

[54] GRAVITY OPERATED LATCH FOR A REFUSE CONTAINER LID

[76] Inventor: Shane Bettenhausen, Box 396, Baker, Mont. 59313

[21] Appl. No.: 868,975

[22] Filed: Jun. 4, 1997

Related U.S. Application Data

[63] Continuation of Ser. No. 621,405, Mar. 25, 1996, abandoned.

[51] Int. Cl.[6] ..... E05C 19/10

[52] U.S. Cl. ..... 292/130; 292/230

[58] Field of Search ..... 292/130, 230, 292/DIG. 22, DIG. 16, 238, 136; 220/908, 315

[56] References Cited

U.S. PATENT DOCUMENTS

| | | | |
|---|---|---|---|
| 196,697 | 10/1877 | Parker | 292/130 |
| 389,110 | 9/1888 | Roselius | 292/130 |
| 845,363 | 2/1907 | Le Bourgeois | 292/130 |
| 852,550 | 5/1907 | Foster | 292/130 |
| 858,866 | 7/1907 | Foster | 292/130 |
| 1,618,348 | 2/1927 | Nicolai | 292/130 |
| 2,730,776 | 1/1956 | Flicker | 292/130 |
| 2,783,071 | 2/1957 | Williams | 292/130 |
| 3,315,828 | 4/1967 | Dubo | 220/908 |
| 3,844,597 | 10/1974 | Elrod et al. | 292/136 |
| 4,520,945 | 6/1985 | Hodge | 220/908 |
| 4,613,174 | 9/1986 | Berg et al. | 292/136 |
| 4,739,896 | 4/1988 | Moss . | |
| 5,415,314 | 5/1995 | McCollum . | |

FOREIGN PATENT DOCUMENTS

| | | | |
|---|---|---|---|
| 480853 | 12/1973 | Australia . | |
| 2056669 | 8/1993 | Canada | 220/315 |
| 33931 | 3/1929 | France | 220/315 |
| 4028917 | 3/1992 | Germany | 220/315 |

*Primary Examiner*—Rodney M. Lindsey
*Attorney, Agent, or Firm*—Edwin W. Greigg; Ronald E. Greigg

[57] ABSTRACT

The invention is a gravity operated latch for a refuse container with a hinged lid. The invention comprises a latch hook built in such a way as to incorporate a counterweight design. The hook is attached to the underside of the container's lid by means of a hinge-plate and pin assembly. The latch hook engages a striker plate which is attached to the same side of the container. When the container is tipped the latch hook will disengage the striker, permitting the hinged lid to open for the emptying of refuse and will re-engage the striker when the container is set upright.

8 Claims, 4 Drawing Sheets

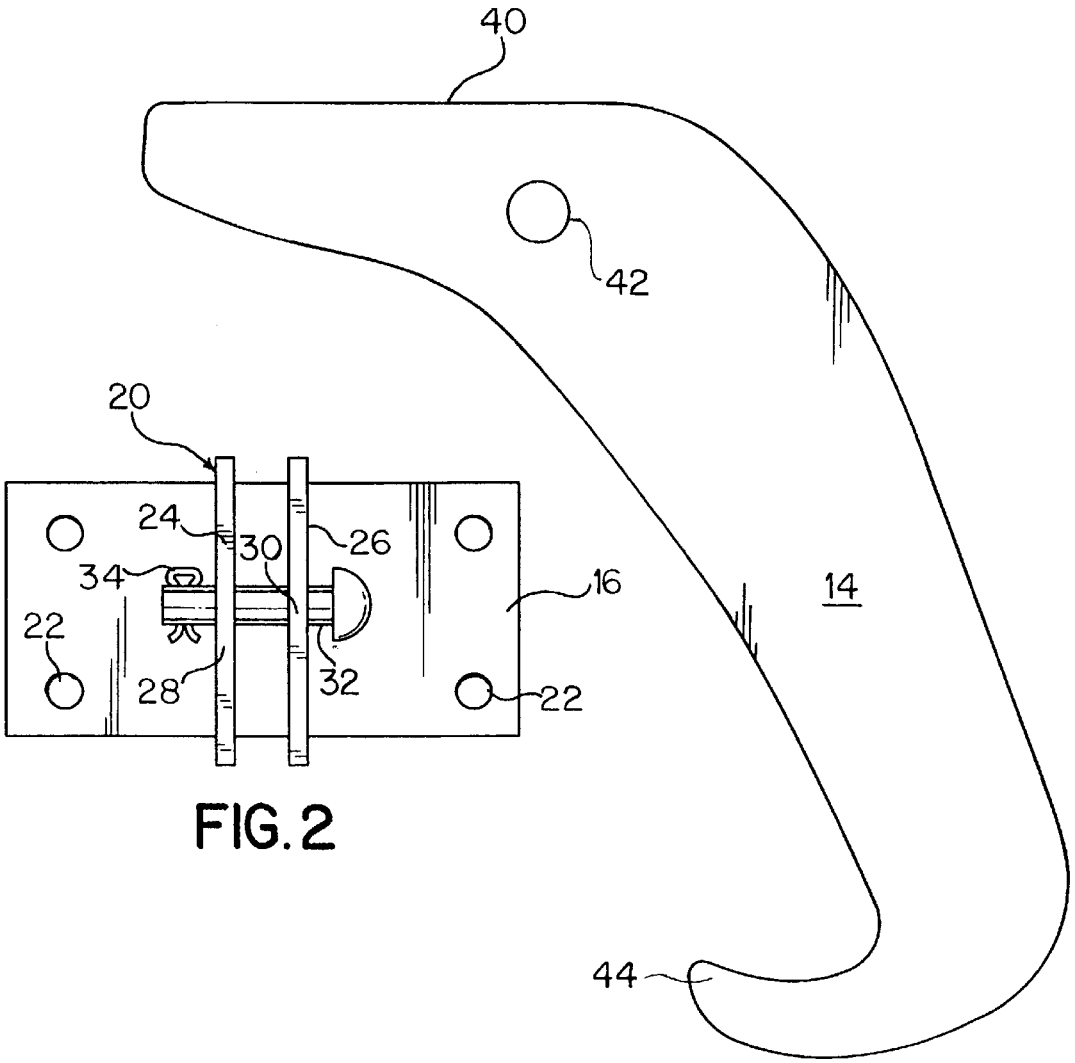
FIG. 2
FIG. 4
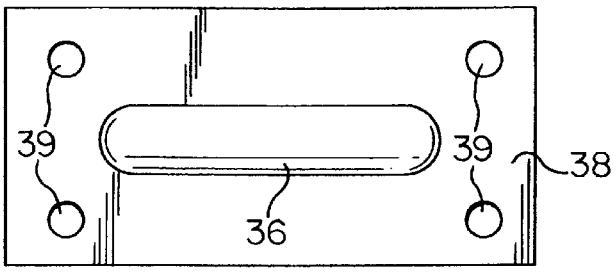
FIG. 3

GRAVITY OPERATED LATCH FOR A REFUSE CONTAINER LID

This is a continuation of application Ser. No. 08/621,405 filed on Mar. 25, 1996 now abandoned.

TECHNICAL FIELD OF THE INVENTION

This invention relates to automatic locking devices on refuse or trash containers with hinged lids. More specifically, it is directed to refuse containers filled in an upright position and emptied by mechanical means into a collection vehicle.

BACKGROUND OF THE INVENTION

There are many containers locking devices, however, the present invention differs from the others in a number of important areas. To begin with, many of the previous devices are designed to lock the lid, thereby stopping unauthorized use of the receptacle and usually adding to the expense of the use of the invention. The present invention however, intends only to secure the lid in instances of severe weather conditions and high winds which under normal operating conditions could blow the hinged lid open permitting refuse to be blown out of the container. The present invention will also keep the hinged container lid from cracking and breaking due to fatigue caused by the lid being repeatedly blown open. The design of the invention allows a trash collection truck to empty the container by mechanical means while the driver remains in the vehicle. The design of the hook mechanism uses a unique counterweight design to distribute the weight of the hook in a manner that allows the hook to fall away from a striker by means of gravity when the container is tipped from a vertical position, allowing the lid to open and refuse to be emptied.

When set upright again the hook will re-engage the striker automatically through the action of gravity on the counterweight hook. The hook design will also allow easy dumping of refuse into the container by simply lifting the hook forward and lifting the lid by hand. The hook's design also limits travel inward so that the hook cannot fall inside the container. The upper rear of the hook is designed so that it will come in contact with the container lid, thereby stopping rearward travel and keeping the hook mechanism outside the container walls. The straight-forward design of the mechanism is important in that it will reduce the cost to manufacture the invention, thereby making it more affordable to buy and use; a second important benefit of the design is that the minimum number of moving parts will resist jamming because of mechanical malfunction or frost in colder climates. For these reasons the present invention will efficiently and effectively solve the problems of container lids blowing open in high winds.

Heretofore, various types of locking mechanisms have been used to close a refuse container and to prevent the lid from opening due to weather conditions. Such devices may be found in the following prior art U.S. Pat. Nos. 4,739,896; 5,042,856; 5,071,024; 5,090,753; 5,094,487; 5,118,000; 5,201,434 and 5,415,314.

OBJECT OF THE INVENTION

Many refuse containers used by private homes have covers which do not have latches so that they can be easily dumped by a mechanical lift. The lids for such refuse containers are easily opened by the wind because they do not have any latch means. This invention provides a simple inexpensive latch means which can be applied to such refuse containers which will lock the lid closed in a normal upright position while automatically permitting the lid to open during a dumping operation when the container has been moved to a certain angle relative to a vertical line.

It is therefore an object of the invention to provide an automatic latch or locking device for a refuse container in which the latch will prevent the lid from opening during a wind storm and yet permit automatic release during dumping the refuse container by a mechanical lift device.

Another object is to provide a refuse container locking mechanism which is simple to make and to install on a refuse container.

Still another object is to provide a simple locking mechanism which permits a user to easily open the latch to raise the lid for dumping refuse into the container.

Yet another object is to provide a refuse container cover locking device which operates automatically to release the lid for dumping the refuse container by use of a mechanical lift device.

These and other objects of the invention will become apparent to one skilled in the art upon a careful reading of the following detailed description along with the accompanying drawings.

BRIEF DESCRIPTION OF THE DRAWINGS

FIG. 2 illustrates a bottom view of a hinge plate illustrating a securing pin in combination with the hinge-plate;

FIG. 3 illustrates a latch hook;

FIG. 4 illustrates a side view of a latch;

DETAILED DESCRIPTION OF THE INVENTION

Figure 1:
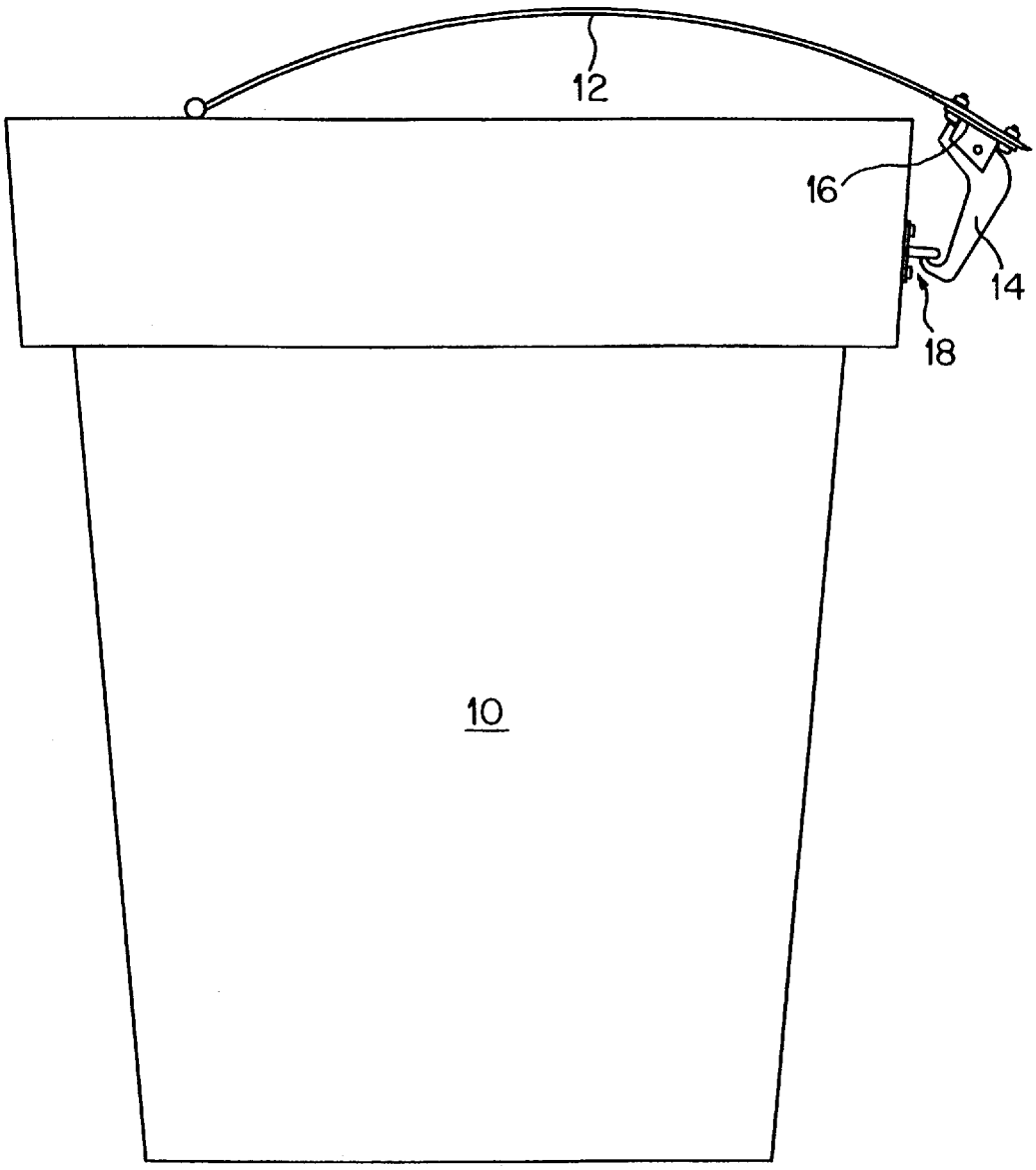
FIG. 1 illustrates a side view of a refuse container including a lid with the inventive latch in a lid closure retaining position.

Now referring to the drawings where the same reference characters refer to the same parts, there is shown in FIG. 1, a side view of a trash or refuse container 10 having a lid 12 which is maintained in a closed position by a latch 14 which is secured at its upper end to a hinge plate 16, with the bottom end of the latch 14 fitted below a striker plate 18. The hinge plate, latch and striker plate are shown more clearly in FIGS. 2–4. FIG. 2 illustrates a securing hinge plate 16 which is secured to the underside of the container cover by suitable screws or bolts, not shown, by use of holes 22. A securing hinge 20 is provided with integral spaced hinge arm 24, 26 that extend outwardly from the hinge plate 16. The hinge arms are provided with oppositely disposed holes 28, 30 through which a bolt 32 passes in order to secure the latch between the arms 24 and 26. The bolt 32 is provided with some type of securing means such as a nut or a cotter pin 34, as shown.

FIG. 3 illustrates the striker plate 18 which includes a catch or rod 36 which is secured to a side of the container by a base 38 in alignment with the latch 14 so that an end of the latch can rotate under the rod 36 of the striker plate by which the bottom end of latch 14 is below the rod 36 to prevent the lid from opening when not desired to be opened. Apertures 39 are shown for securing the plate to the front of the container.

FIG. 4 illustrates a side view of the latch 14. The latch 14 is configured somewhat in the shape of a "J". The upper end 40 is flat and the upper portion has a hole 42 which mates with the holes 28 and 30 in the arms 24, 26 of the hinged plate. The shape of the latch is such that the upper end has freedom to rotate around the bolt 32 relative to the underside of the hinge plate. The bottom end of the latch is turned toward the container so that the hook end 44 can fit under the catch 36. The latch is made with a counterweight such that the bottom end 44 will always be positioned in a vertical line when the container is in an upright position or when the container is at an angle relative to a vertical line such as when being "dumped" by a mechanical lifting arm.

Figure 5:
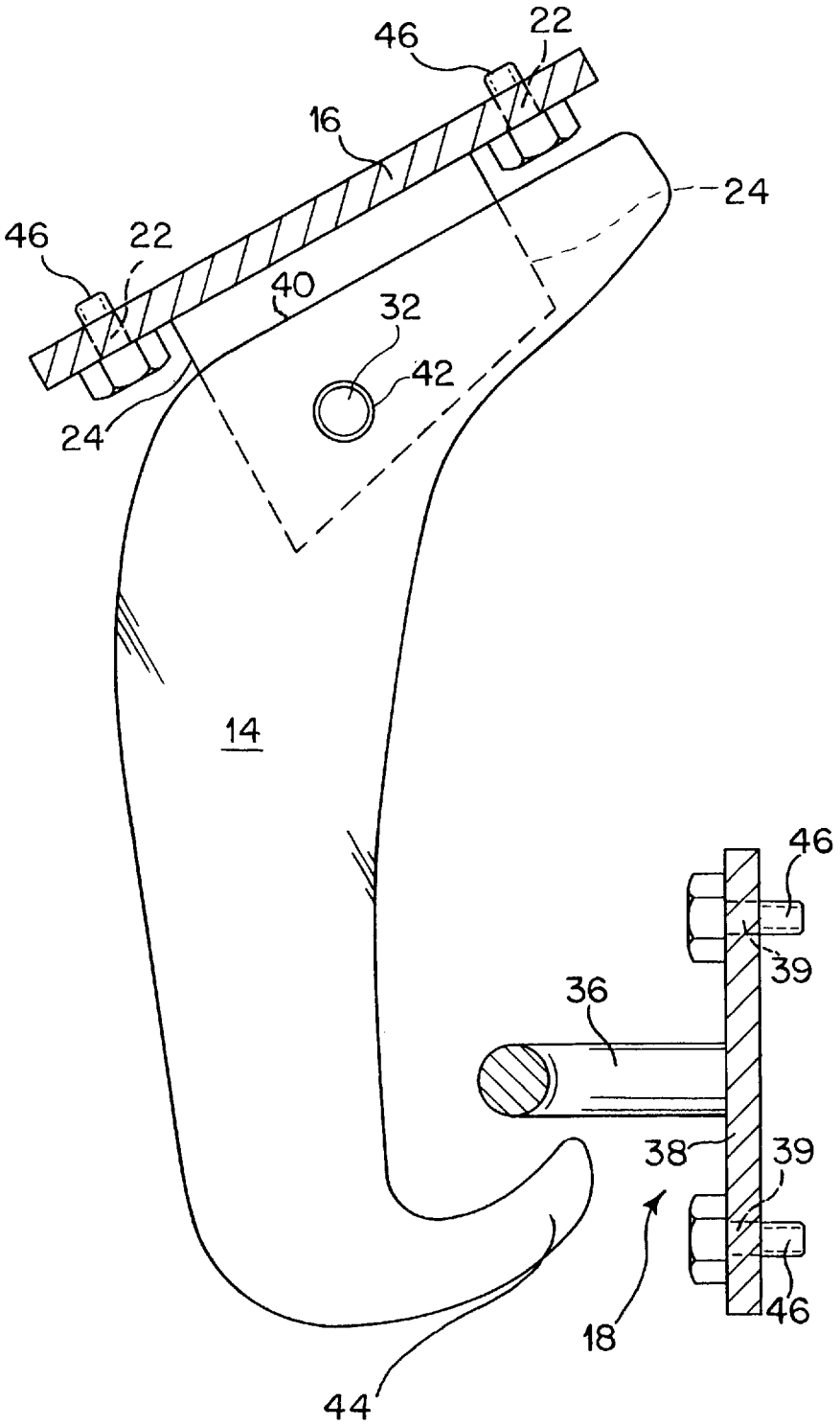
FIG. 5 illustrates a partial hinge plate which is to be secured with the latch hook refuse container door positioned for securing to the hinge plate and with the latch hook positioned relative to a strike plate or latch securing device which is to be secured to a side of a refuse container.

FIG. 5 illustrates a side view of the latch secured to the hinge plate with the lower end of the latch positioned relative to the striker plate 38 with the container in an upright position. Only one arm 24 of the hinge plate is shown so that the latch will be shown in its side view shape. The catch 36 is shown in cross section in order to show the relationship better. The hinge plate can be secured to the cover and the striker plate can be secured to a side of the container by any suitable means such as bolts 46.

Figure 6:
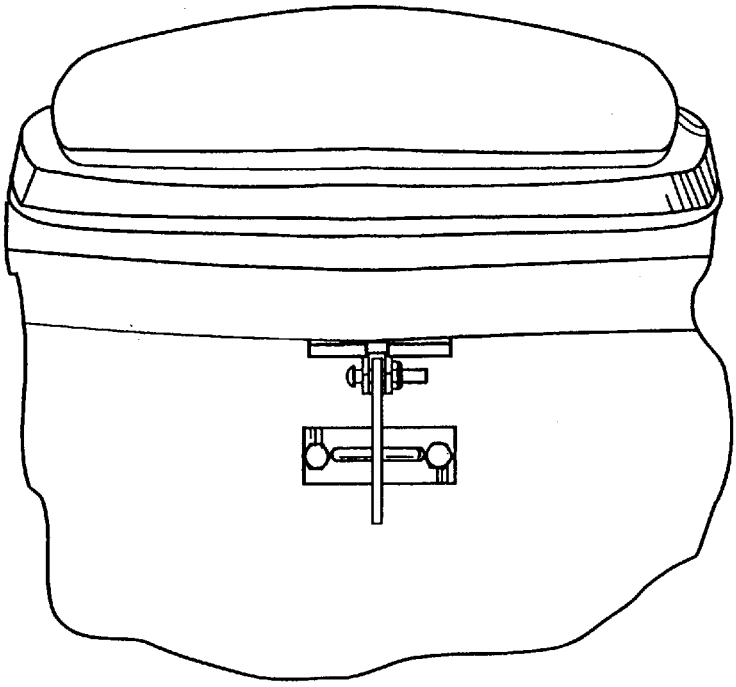
FIG. 6 is an end view of the latch secured in place.
Figure 7:
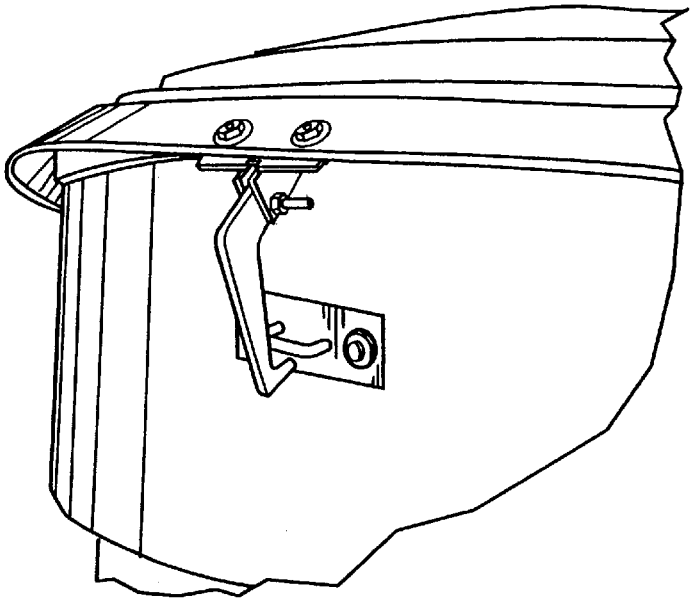
FIG. 7 is a somewhat perspective view of the latch secured in place on a refuse container illustrating the hinge plate, the bolt for holding the latch hook in place, the latch hook and the striker plate which is caught by the hook end of the latch hook.

FIGS. 6 and 7 are different views which illustrate the relationship of the hinge plate, the latch and the striker plate to each other and to the container. The relationship of the latch to the hinge plate and the shape of the upper end of the latch are such that as the container is moved from an angle to a vertical line to an upright position with the container in a vertical line, the latch strikes the lower side of the hinge plate so that the lower end of the latch cannot slide into the inner side of the container. The latch is counterweighted such that the latch is always along a vertical line, thus the latch will unhook from the striker plate 36 when the container is lifted at an angle for dumping and will always lay in position for hooking the striker plate when the container is in an upright position.

In operation, the hinge plate is secured to a front portion under side of the container lid which is identified as the side opposite the lid hinges. The striker plate is secured to the side of the container in a proper relationship with the hinge plate and latch so that the lower end of the latch will fit under the striker plate catch 36. With the can in an upright position, the latch will fit under the striker plate catch and will prevent the cover from opening due to the wind. If a person desires to place some refuse into the container the latch can be pulled outwardly to free the end of the latch from the catch, then the cover can be lifted, as the cover is lowered, the latch will resume its vertical position and will again catch under the striker plate catch 36. When the container is to be dumped, a mechanical arm fits into lifting slots or catches on the sides or back of the container and the container is lifted. As the container is lifted, the latch will remain secured as long as the container is upright. When the container is rotated, at an angle relative to a vertical line the latch will release from the catch and the lid can open to dump the refuse. As the container is lowered to an upright position, the latch seeks a vertical line and will catch under the striker plate catch 36 to prevent to cover from opening due to a wind storm.

This device operates to prevent a container lid from opening due to a wind storm and yet it permits dumping the refuse from the container without having to manually release the latch from the strike plate catch.

It would be obvious to one skilled in the art that the latch can be of any desired shape so long as the catch end will seek a vertical position. Also the striker plate catch could be of any suitable design so long as the latch will catch the striker plate catch when in a vertical position.

The foregoing relates to preferred exemplary embodiments of the invention, it being understood that other variants and embodiments thereof are possible within the spirit and scope of the invention, the latter being defined by the appended cliams.

What is claimed is:

1. A gravity operated latch device adapted for use with a refuse container which comprises a latch and a hinge plate for attaching and locating said latch to an underside surface of a refuse container lid when said container is upright and said lid is closed, which lid has a portion that extends beyond an outer surface of said refuse container, said hinge plate including spaced hinge arms which extend outwardly from one surface of said hinge plate that is adapted to be secured to said underside surface of said refuse container lid, said latch is rotatably secured between said spaced hinge arms by a latch securing means, said latch including a counter weight portion which functions to rotate said latch into a vertical position when said hinge plate is installed on the underside surface of the lid of the refuse container and the refuse container is in a vertical upright position, said latch includes means relative to said hinge plate to prevent a bottom end of said latch from rotating beyond a vertical line through said latch securing means, a striker plate which is adapted to be secured to a vertical side surface of said refuse container and along a vertical line relative to said latch, said striker plate including an outwardly protruding catch below which an end of said latch rests when said latch is in a vertical position relative to said catch and from which said latch is automatically released when said refuse container is tipped toward the latch at an angle relative to a vertical line.

2. A gravity operated latch as set forth in claim 1, in which said means to prevent a bottom end of said latch from rotating beyond a vertical line through said latch securing means includes an upper end of said latch securing means, and said bottom end of said latch has a shape of a hook with the hook facing said catch on said striker plate, and said hook has a length sufficient for said latch to pass said catch when said catch is secured to a side of said container and when said refuse container is in an upright position.

3. A gravity operated latch as set forth in claim 2, in which said striker plate is adapted to be secured to a side surface of said refuse container in a vertical alignment with said latch and positioned such that said bottom end of said latch extends below said catch on said striker plate when said refuse container is in an upright position.

4. A gravity operated latch device for use with a refuse container which comprises a latch and a hinge plate which is adapted to secure and locate said latch on an underside of a lid for said container when said container is upright and said lid is closed, said hinge plate including spaced hinge arms which extend outwardly from one surface of said hinge plate, means for rotatably securing said latch to said spaced hinge arms, said latch including a counter weight which functions to rotate said latch relative to said hinge plate into a vertical position when said hinge plate is installed on said lid and said lid is installed on said refuse container, a striker plate for attachment to said refuse container which is adapted to be secured to a side of said refuse container relative to said latch, said striker plate including a catch which is adapted to be secured below said latch in a position on said refuse container so that an end of said latch rests below said catch when said latch is in a vertical position relative to said catch, and said latch will be automatically removed from below said catch if the refuse container is at an angle relative to a vertical line so that the container lid can be opened.

5. A gravity operated latch as set forth in claim 4, in which said latch is secured between said hinge arms and rotatable about a latch securing means.

6. A gravity operated latch as set forth in claim 5, in which said latch includes means to prevent a bottom end of said latch from rotating beyond a vertical line through said latch securing means.

7. A gravity operated latch as set forth in claim 6, in which said latch includes an upper end that prevents rotation beyond said vertical line through said latch securing means and said bottom end of said latch has a shape of a hook in which the hook faces said catch on said striker plate when said striker plate is secured to said container.

8. A gravity operated latch as set forth in claim 7, in which said striker plate is adapted to be secured to a side surface of said refuse container in alignment with said latch and positioned such that said bottom end of said latch rests below said catch on said striker plate when said striker plate is secured to said refuse container and said refuse container is in an upright vertical position.

* * * * *